US006035448A

United States Patent [19]

Thomson

[11] Patent Number: 6,035,448

[45] Date of Patent: Mar. 14, 2000

[54] SLACKS WITH BUILT-IN GIRDLE PANEL

[76] Inventor: Christine A. Thomson, 171 E. 84th St., Ste. 9G, New York, N.Y. 10028

[21] Appl. No.: 08/912,610

[22] Filed: Aug. 18, 1997

[51] Int. Cl.[7] ..... A41D 1/06

[52] U.S. Cl. ..... 2/227; 2/237

[58] Field of Search ..... 2/221, 401, 237, 2/220, 227, 235, 236

[56] References Cited

U.S. PATENT DOCUMENTS

| | | |
|---|---|---|
| 2,334,311 | 11/1943 | Cadous . |
| 2,335,971 | 12/1943 | Scholle . |
| 2,815,023 | 12/1957 | Hammersley . |
| 3,076,201 | 2/1963 | Winter . |
| 3,234,947 | 2/1966 | Bergstein . |
| 3,422,461 | 1/1969 | Froehlich . |
| 3,425,063 | 2/1969 | Brown . |
| 3,527,222 | 9/1970 | June . |
| 3,559,213 | 2/1971 | Goodman . |
| 3,723,993 | 4/1973 | Ruby . |
| 3,869,728 | 3/1975 | Spencer . |
| 4,332,034 | 6/1982 | Muse . |
| 4,538,615 | 9/1985 | Pundyk . |
| 5,036,548 | 8/1991 | Grilliot . |
| 5,052,058 | 10/1991 | Mueller . |
| 5,157,790 | 10/1992 | Aldridge . |
| 5,168,581 | 12/1992 | Garcia et al. . |
| 5,219,367 | 6/1993 | Fields . |
| 5,351,340 | 10/1994 | Aldridge . |
| 5,373,587 | 12/1994 | Sexton . |
| 5,447,462 | 9/1995 | Smith et al. . |
| 5,483,702 | 1/1996 | D'Ambrosio . |
| 5,539,926 | 7/1996 | Mantos . |
| 5,590,548 | 1/1997 | Osborne . |

*Primary Examiner*—John J. Calvert
*Assistant Examiner*—Shirra L. Jenkins
*Attorney, Agent, or Firm*—Lilling & Lilling P.C.

[57] ABSTRACT

A control panel is included in a pair of trousers in order to support and hold the stomach and abdomen. In particular, the control panel is made of a girdle like fabric and has a greater degree of elasticity in the horizontal direction than in the vertical direction. A front edge of the control panel is attached by a line of stitching on the inside of the pants along the length of the zipper, a rear edge of the control panel is attached along the line of stitching in the vicinity of the inseam and the top edge of the control panel is attached along a line of stitching at the waistband. The bottom edge of the control panel is not attached and hangs free.

3 Claims, 1 Drawing Sheet

FIG. 1
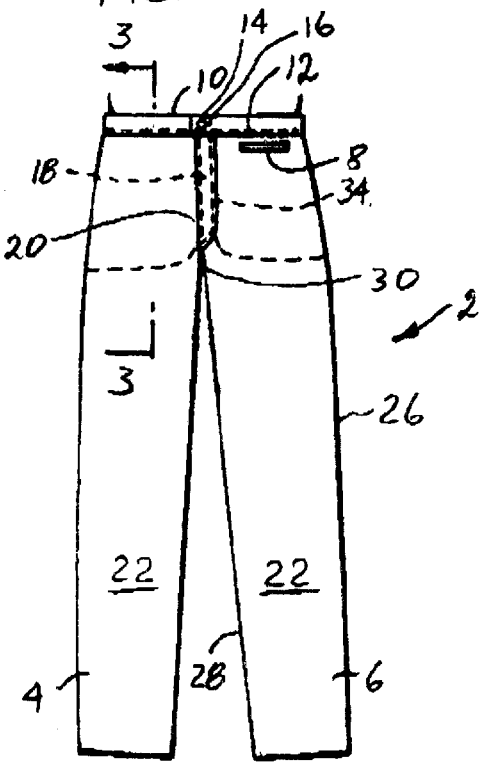
FIG. 2
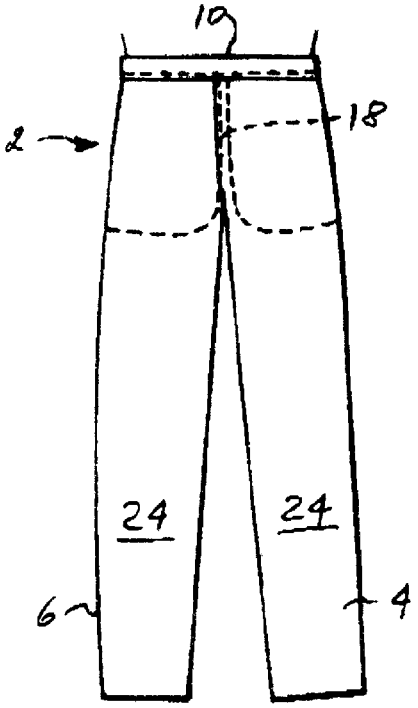
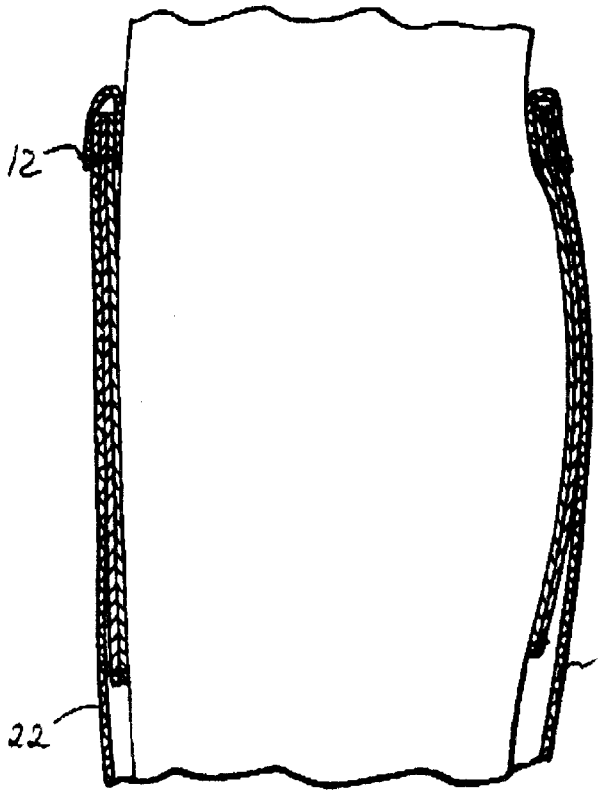
FIG. 3

SLACKS WITH BUILT-IN GIRDLE PANEL

FIELD OF THE INVENTION

The invention relates to the clothing industry and, in particular, to a stomach control panel that is sewn into pants, shorts and skirts.

BACKGROUND OF THE INVENTION

For many years, there have been various types of garments available that may be used to adjust a person's figure, so that they will look better. Frequently, these garments include some type of control fabric that is used to hold the stomach or lower abdomen.

In most cases, foundation garments are used for providing the necessary control over the contours of the body. Pundyk (U.S. Pat. No. 4,538,615) discloses one particular multi-panel foundation garment, but there are many similar products in the market place.

It is also know in the industry to provide elastic waistbands in pants, so that the trousers can be used by people of many different sizes. Muse (U.S. Pat. No. 4,332,034) discloses one particular pair of trousers with an elastic band. Again, many such variants exist in the market place.

What does not exist in the market place is a one piece garment which includes trousers (or shorts or a skirt) with a built-in "girdle" panel. There are separate foundation garments, like girdles, and there are trousers with elastic waistbands, but there are no trousers that include a built in girdle panel.

Therefore, there is a need in the industry for a one-piece garment that is fashionable and also includes a built-in control panel to better shape and define the contour of the figure.

SUMMARY OF THE INVENTION

Therefore, it is an object of this invention to provide a garment with a built-in control panel. Such a garment makes it possible for the fashion conscious person to select a single garment that will have a control panel to adjust, hold and define the figure.

This object is obtained by a conventional pair of trousers, which includes a girdle like panel sewn in the inside. In particular, the girdle panel is sewn between the fly front, the waistband and the side seem and is freely disposed at its lower edge. This provides the required degree of tautness and enables the girdle panel to hold and shape their body when the trousers are closed around the wearers body.

BRIEF DESCRIPTION OF THE DRAWINGS

FIG. 1 is a front view of the trousers with the built-in control panel.

FIG. 2 is a rear view.

FIG. 3 is a cross sectional view taken along lines 3—3 of FIG. 1.

DETAILED DESCRIPTION OF THE INVENTION

For purposes of illustration, the invention is illustrated as being included in a pair of trousers. It may be appreciated that the invention will work as well in any similar garment, such as skirts, shorts, culottes and any other garments that can be worn over the lower extremities and about the waist. Garments for both men and women can be implemented with the invention.

Further, the pants or other garments can be made of any conventional material, such as cotton, wool, synthetics, and blends of materials.

As illustrated, the trousers 2 are of a conventional style with a right leg 4 and a left leg 6. The lower portion of each leg can be straight, or flared. There can be a central crease and the bottom portion may or may not have a cuff. Any of these standard fashions are acceptable and can be used with the invention.

Any type of pocket 8 may be provided in the legs. These pockets may either have a straight top or a slash pocket. A watch pocket may also be provided. The inclusion or non-inclusion of a pocket will have no effect on the inclusion of the control panel.

If desired, the trousers may include pleats.

A waistband 10 is included and is sewn along a line of stitching 12 to the top end of each leg of the pants. The construction of the waistband is conventional. Belt loops may be provided.

To close the pants, a button 14 may be provided on one side of the waistband and an opposing button hole 16 is provided on the opposing side of the waistband. An interior aligned button and button hole may be provided if desired. To properly close the pants, a zipper 18 is included with a fly front 20.

Each of the legs consists of front and rear panels 22 and 24. They are sewn together along a side seam 26 and an inseam 28, as is conventional in the industry. The two legs are sewn together by stitching along a crotch seam 30 that extends from the bottom of the zipper 18 and extends down through the crotch region and up through the seat of the pants. This construction is well know in the industry. As described, the trousers are of conventional design and material.

The control panel is secured on the inside of the trousers. The front edge of the control panel is sewn on the inside and along the entire front body of the garment and along the same line of stitching 34 as is used to connect the zipper to the front edge of the pants. The top edge of the control panel is connected to the pants with the line of stitching 12 that is used to connect the waistband to the legs of the pants. The rear edge of the control panel is attached to the pants with the line of stitching that constitutes the upper portion of the side seam to connect the front and rear portions of the legs. There is no stitching to secure the bottom edge of the control panel and it hangs down freely. The overall size of the control panel may vary depending on the size of the person for whom the garment is fitted. The control panel is made of power netting-a girdle fabric with a long stretch of 165 per square ounce and a width stretch of 65 per square ounce. It is a mixture of nylon and spandex synthetic fibers. In the preferred embodiment, the control panel is 14% spandex synthetic fiber spandex with a denier size of 210; nylon with a denier size of 70 makes up the remainder of the material. The degree of stretch is greater in the horizontal plane than in the vertical plane. Any material that is typically used as a control panel in a girdle may be used as the control panel in this invention.

When the pants are closed, the control panel fits closely against the stomach or abdomen and firmly holds the figure of the body.

In alternate embodiments, the zipper may be in the back of the pants and the connection of the front and rear edges of the control panel would be reversed so that the control cover panel runs along the entire front of the garment. The function and placement of the control panel would still, however, be substantially the same.

Similarly, the control panel may be used in skirts. The criteria for proper placement of the control panel is that the front and rear edges must be secured in the vicinity of the front of the garment and at the side seam; the top edge of the control panel should be secured in the vicinity of the waistband and the bottom edge of the control panel should be permitted to hang free.

The control panel has a plurality of parallel elastomers which are aligned horizontally in the fabric. Thus, the true stretch of the fabric is in the horizontal direction in line with the elastomers. These elastomers correspond to the warp of the knitted material. Connecting the elastomers are a plurality of weft stringers, which are less elastic. Thus, the degree of stretch in the vertical direction is much less than in the horizontal direction. The combination of the horizontally aligned elastomers and the vertically arranged stringers creates a power netting type fabric that is used to control and hold the stomach when the garment is worn.

The invention is described in detail with reference to a particular embodiment, but it should be understood that various other modifications can be effected and still be within the spirit and scope of the invention.

I claim:

1. Clothing for holding and supporting the stomach and abdomen, comprising right and left legs having front and rear sections sewn together at a side seam and an inseam, and a waistband attached along a line of stitching to said legs; wherein the improvement comprises a elastic control panel made from a fabric consisting of synthetic fibers for holding the stomach and abdomen, wherein the elastic control panel has a greater degree of elasticity in a horizontal direction than in a vertical direction, and wherein a front edge of the control panel is stitched along a line of stitching to the front of the clothing, a rear edge of the control panel is attached to a line of stitching to said side seams of said clothing, a top edge of the control panel is attached to said line of stitching at the junction between the waistband and legs, and the bottom edge of the control panel is not affixed to the clothing and hangs freely extending down to the crotch area of the garment.

2. A elastic control panel for a garment to support and hold the stomach and abdomen, said elastic control panel being made from a fabric consisting of synthetic fibers and having a greater degree of elasticity in a horizontal direction than in a vertical direction, and wherein a front edge of said control panel is attached along a line of stitching to the inside of the front of the garment, a rear edge of said control panel is attached to along a line of stitching along a side seam of the garment, a top edge of said control panel is attached along a line of stitching in the vicinity of the waistband of the garment and the lower edge of the control panel hangs freely extending down to the crotch area of the garment.

3. A garment for outerware comprising a lower extremity encircling portion extending below and supported from a waistline and having a waistband connected by a line of stitching to said encircling portion, wherein the improvement comprises a elastic control panel positioned and attached on the inside of the garment for holding and supporting the stomach or abdomen wherein said elastic control panel is made from a fabric consisting of synthetic fibers and has a greater degree of elasticity in a horizontal direction then in a vertical direction and wherein a front edge of said control panel is attached along a line of stitching to the inside of a front portion of said garment, a rear edge of said control panel is attached along a line of stitching in the vicinity of a side seam of said garment, a top edge of said control panel is attached to said line of stitching to the waistband and a bottom edge of said control panel hangs freely extending down to the crotch area of the garment.

* * * * *